US008294735B2

(12) United States Patent
Chao et al.

(10) Patent No.: US 8,294,735 B2
(45) Date of Patent: Oct. 23, 2012

(54) METHOD FOR AUTOMATICALLY DETECTING AND ADJUSTING GRAYSCALE/WHITE BALANCE OF DISPLAY

(75) Inventors: Wen-Chwan Chao, Hsinchu (TW); Yi-Sheng Yu, Taoyuan (TW); Hsu-Pin Kao, Pingjhen (TW)

(73) Assignee: Marketech International Corp., Taipei (TW)

( * ) Notice: Subject to any disclaimer, the term of this patent is extended or adjusted under 35 U.S.C. 154(b) by 1501 days.

(21) Appl. No.: 11/643,862

(22) Filed: Dec. 22, 2006

(65) Prior Publication Data

US 2008/0055339 A1 Mar. 6, 2008

(30) Foreign Application Priority Data

Aug. 30, 2006 (TW) ..... 95131921 A

(51) Int. Cl.
*G09G 5/10* (2006.01)

(52) U.S. Cl. ..... 345/690; 345/204; 345/603; 345/63; 345/77; 345/89; 345/589; 348/223.1; 348/229.1; 348/280; 348/366

(58) Field of Classification Search ..... 345/589, 345/690, 603, 204, 63, 77, 89; 348/223.1, 348/229.1, 280, 348, 366
See application file for complete search history.

(56) References Cited

U.S. PATENT DOCUMENTS

2003/0001958 A1* 1/2003 Hoshuyama ..... 348/223.1
2003/0117414 A1* 6/2003 Sasaki ..... 345/589

* cited by examiner

*Primary Examiner* — Lun-Yi Lao
*Assistant Examiner* — Olga Merkoulova
(74) *Attorney, Agent, or Firm* — Bacon & Thomas, PLLC

(57) ABSTRACT

A method for automatically detecting and adjusting grayscale/white balance of a display comprises the steps of: detecting a chromaticity coordinate and a brightness of a present white color of the display by a detector; selecting a chromaticity coordinate of three primary colors of red, green, and blue in a known chromaticity space for automatically calculating a present mixing ratio of the three primary colors of red, green, and blue of the present white color of the display according to Grassman's Law of color mixture in colormetry; calculating a desired mixing ratio of three primary colors of red, green, and blue of an ideal white color under a predetermined color temperature; and comparing the present mixing ratio with the desired mixing ratio to obtain a proportion therebetween which is used as a set of gain values of the three primary colors of red, green of the display.

7 Claims, 4 Drawing Sheets

| | Chromaticity coordinate of white color | | | Mixing ratio of three primary colors | | | Gain values of three primary colors | | | Color temperature (K) | | Color deviation (duv) | |
|---|---|---|---|---|---|---|---|---|---|---|---|---|---|
| | $x_{wp}$ | $y_{wp}$ | $Y_{wp}$ | $Y_{rp}$ | $Y_{gp}$ | $Y_{bp}$ | R | G | B | Before adjustment | After adjustment | Before adjustment | After adjustment |
| 1 | 0.2792 | 0.2821 | 70.44 | 0.0562717 | 0.1956217 | 0.0302066 | 127 | 128 | 126 | 10600 | 9210 | -0.002 | -0.0004 |
| 2 | 0.2825 | 0.2485 | 63.18 | 0.2066657 | 0.2142960 | 0.5790383 | 85 | 128 | 81 | 14000 | 8670 | -0.0229 | -0.0006 |
| 3 | 0.3092 | 0.3295 | 76.57 | 0.0701876 | 0.2356376 | 0.0236749 | 88 | 92 | 128 | 6710 | 9230 | 0.0053 | -0.0006 |
| 4 | 0.2876 | 0.2788 | 68.43 | 0.0635439 | 0.1853439 | 0.0299122 | 107 | 128 | 111 | 9710 | 9020 | 0.0093 | -0.0002 |
| 5 | 0.2786 | 0.2797 | 69.89 | 0.0562892 | 0.1929392 | 0.0304717 | 126 | 128 | 113 | 10800 | 9210 | -0.0029 | 0.0005 |
| 6 | 0.2745 | 0.2857 | 165.3 | 0.0518455 | 0.2036455 | 0.0302090 | 128 | 114 | 107 | 10940 | 9156 | 0.0029 | -0.0009 |
| 7 | 0.2839 | 0.2898 | 383.4 | 0.0583960 | 0.2022460 | 0.0291579 | 127 | 128 | 124 | 9561 | 9053 | -0.001 | 0.0006 |

FIG. 2

METHOD FOR AUTOMATICALLY DETECTING AND ADJUSTING GRAYSCALE/WHITE BALANCE OF DISPLAY

FIELD OF THE INVENTION

The present invention relates to a method for automatically detecting and adjusting a display, and more particularly to a method for automatically detecting and adjusting the grayscale/white balance of a display.

BACKGROUND OF THE INVENTION

Traditionally, when manufacturing displays, such as plasma display panels (PDP) and liquid crystal displays (LCD), the displays generally can not provide a sufficient uniformity of the illuminating ratio of three primary colors, i.e. red, green, and blue. As a result, display manufacturers can not ensure that each of the manufactured displays can exhibit optimal color performances even though the displays in the same batch are manufactured by the same manufacturer, and with the same process. Thus, after the displays are manufactured, the grayscale/white balance of the displays will be adjusted by the manufacturer before outputting final products. Presently, the typical adjusting method comprises the following steps: detecting the color temperature and the color deviation of the display by a detector during the display displays a white color; and manually adjusting gain values of the three colors of red, green, and blue until the white color of the display is close to a predetermined range of the color temperature and the color deviation. Accordingly, the manufactured displays will be adjusted to exhibit a relatively correct grayscale/white balance with optimal color performances. However, the step of manually adjusting parameters of the grayscale/white balance needs more manufacturing time and manual labor while it is easy to cause manual deviation during manual adjusting. Thereby, a considerable difference is inevitably existed between actual parameters of the grayscale/white balance of the display and the predetermined parameter range thereof so as to relatively reduce the uniformity of final product quality.

Furthermore, conventionally, for lowering the cost of manufacture time and manual labor and speeding parameter adjustment of grayscale/white balance, display manufacturers generally select one display per batch to adjust its parameter of grayscale/white balance so as to obtain gain values of its three primary colors of red, green, and blue, which are used as a benchmark for determining gain values of other displays in the same batch and adjusting parameters of grayscale/white balance thereof. Briefly, gain values of all displays in the same batch are adjusted to the same fixed values in order to save considerable cost of manufacturing time and manual labor and to speed parameter adjustment of grayscale/white balance of the displays. However, differences of color performances between each of the displays are not considered so as to lower actual color performances of most displays. In fact, only one display, i.e. the selected one, can exhibit optimal color performances, and other displays can not exhibit optimal color performances at all.

SUMMARY OF THE INVENTION

It is therefore tried by the inventor to develop a method for automatically detecting and adjusting the grayscale/white balance of a display to solve the problems existed in the conventional method for manually adjusting the grayscale/white balance of a display which can not ensure that each of displays in one batch exhibits optimal color performances when outputting the batch in consideration of economic effect.

A primary object of the present invention is to provide a method for automatically detecting and adjusting the grayscale/white balance of a display according to a colormetry principle, i.e. Grassman's Law of color mixture, which proposes that any color can be constituted by suitably mixing three primary colors of red, green, and blue, wherein the method comprises the steps of: detecting a chromaticity coordinate and a brightness of a present white color of the display by a detector; selecting a chromaticity coordinate of three primary colors of red, green, and blue in a known chromaticity space for automatically calculating a present mixing ratio of the three primary colors of red, green, and blue of the present white color of the display according to Grassman's Law of color mixture in colormetry; meanwhile, calculating a desired mixing ratio of three primary colors of red, green, and blue of an ideal white color under a predetermined color temperature; and comparing the present mixing ratio with the desired mixing ratio to obtain a proportion therebetween which is used as a set of gain values of the three primary colors of red, green, and blue of the display so that the display can be adjusted until the display exhibits optimal color performances.

A secondary object of the present invention is to provide a method for automatically detecting and adjusting the grayscale/white balance of a display, which is provided with suitable circuit and program designs so that the set of gain values as described above can be automatically written into a memory of the display for adjusting the grayscale/white balance of the display until the display exhibits optimal color performances while overcoming related problems existed in the conventional method for manually adjusting the grayscale/white balance of a display which needs more manufacturing time and manual labor. Furthermore, the manual deviation of the conventional method during manually adjusting can be efficiently prevented.

The structure and the technical means adopted by the present invention to achieve the above and other objects can be best understood by referring to the following detailed description of the preferred embodiments and the accompanying drawings, wherein

BRIEF DESCRIPTION OF THE DRAWINGS

FIG. 2 is an experimental data table according to the first preferred embodiment of the present invention shown in FIG. 1 after adjusting the display;

DETAILED DESCRIPTION OF THE PREFERRED EMBODIMENTS

Figure 1:
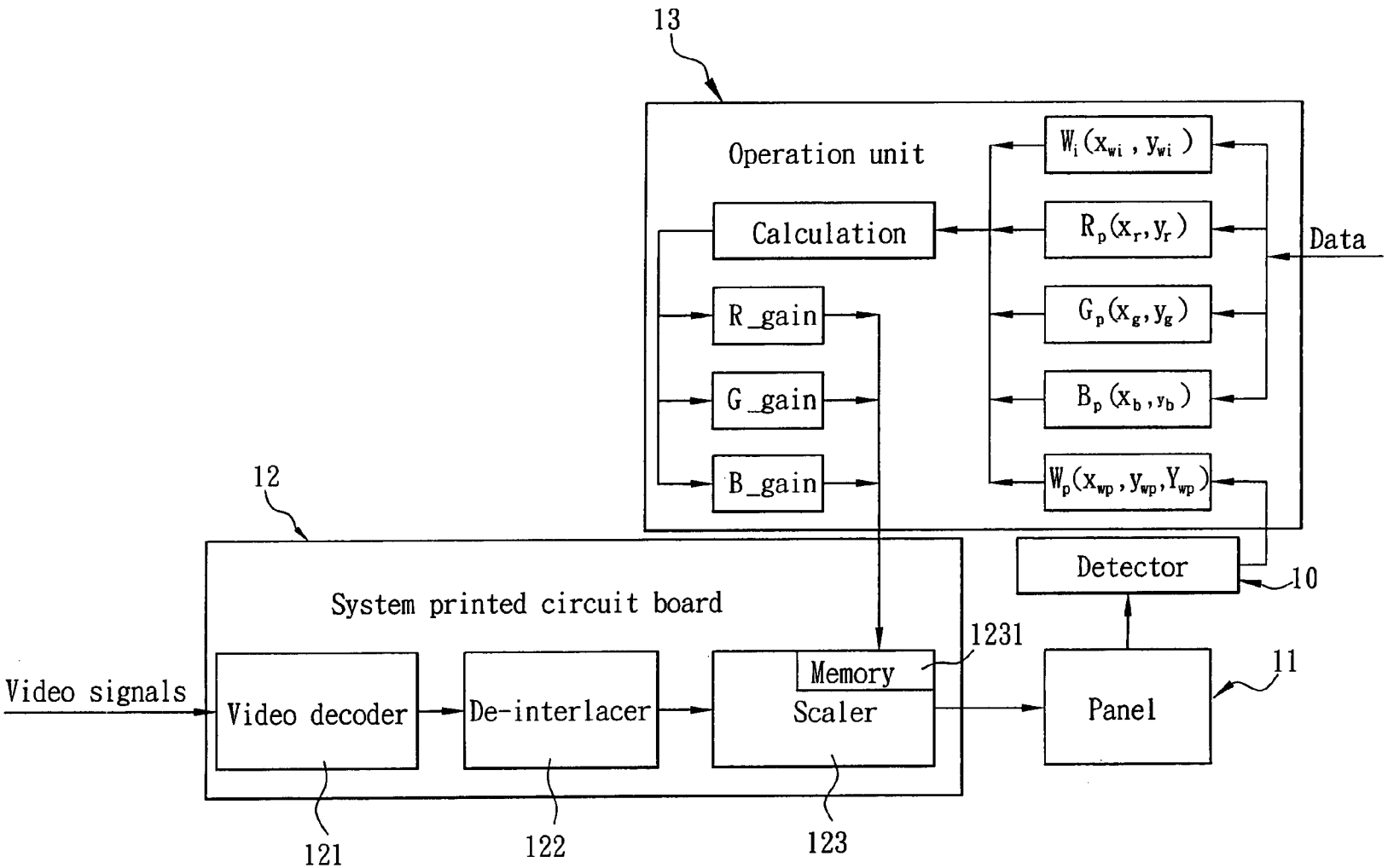
FIG. 1 is a block diagram of a circuit used in a method for automatically detecting and adjusting the grayscale/white balance of a display according to a first preferred embodiment of the present invention.

In the present invention, a method for automatically detecting and adjusting the grayscale/white balance of a display is provided, which is according to a colormetry principle, i.e. Grassman's Law of color mixture, which proposes that any color can be constituted by suitably mixing three primary colors of red, green, and blue, wherein the method of the present invention comprises the steps of: detecting a chromaticity coordinate and a brightness of a present white color of a display by a detector; selecting a chromaticity coordinate of three primary colors of red, green, and blue in a known chromaticity space, such as selecting a chromaticity coordinate R(0.64, 0.33), G(0.29, 0.6) and B(0.15, 0.06) of three primary colors of red, green, and blue of an EBU (European Broadcast Union) recommendation for automatically calculating a present mixing ratio of the three primary colors of red, green, and blue, which is used to constitute the present white color of the display according to Grassman's Law of color mixture in colormetry; meanwhile, calculating a desired mixing ratio of three primary colors of red, green, and blue, which is used to constitute an ideal white color under a predetermined color temperature; and comparing the present mixing ratio with the desired mixing ratio to obtain a proportion therebetween which is used as a set of gain values of the three primary colors of red, green, and blue of the display so that the display can be adjusted until the display exhibits optimal color performances.

According to a transformation equation of a color system proposed by the Commission Intornation De'l E'clairage (CIE), a chromaticity coordinate and a brightness (x, y, Y) can be transformed into three theoretically primary colors (X, Y, Z) by the following equation (1), wherein X, Y, and Z are stimulation values (i.e. stimulation energies for human eyes) of three primary colors of red, green, and blue, respectively:

$$(X, Y, Z) = \left(\frac{x \cdot Y}{y}, Y, \frac{(1 - x - y) \cdot Y}{y}\right) \tag{1}$$

Thereby, in the present invention, if the chromaticity coordinate and the brightness of the present white color of the display detected by the detector is $W_p(x_{wp}, y_{wp}, Y_{wp})$ , the three theoretically primary colors is as shown in the following equation (2):

$$W_p(X_{wp}, Y_{wp}, Z_{wp}) = \left(\frac{x_{wp} \cdot Y_{wp}}{y_{wp}}, Y_{wp}, \frac{(1 - x_{wp} - y_{wp}) \cdot Y_{wp}}{y_{wp}}\right) \tag{2}$$

Meanwhile, based on Grassman's Law of color mixture which proposes that any color can be constituted by suitably mixing three primary colors of red, green, and blue according to a suitable brightness ratio, if the three primary colors of red, green, and blue are $R_p(x_r, y_r)$ $G_p(X_g, y_g)$ and $B_p(x_b, y_b)$ the chromaticity coordinate and the brightness of the present white color of the display $W_p(x_{wp}, y_{wp}, Y_{wp})$ should have three theoretically primary colors $W_p(X_{wp}, Y_{wp}, Z_{wp})$ which can be calculated from three theoretically primary colors $R_p(X_{rp}, Y_{rp}, Z_{rp})$ of the chromaticity coordinate $R_p(x_r, y_r)$ and the brightness $Y_{rp}$ of red color, three theoretically primary colors $G_p(X_{gp}, Y_{gp}, Z_{gp})$ of the chromaticity coordinate $G_p(x_g, y_g)$ and the brightness $Y_{gp}$ of green color, and three theoretically primary colors $B_p(X_{bp}, Y_{bp}, Z_{bp})$ of the chromaticity coordinate $B_p(x_b, y_b)$ and the brightness $Y_{bp}$ of blue color as shown in the following equation (3):

$$W_p(X_{wp}, Y_{wp}, Z_{wp}) = R_p(X_{rp}, Y_{rp}, Z_{rp}) + G_p(X_{gp}, Y_{gp}, Z_{gp}) + B_p(X_{bp}, Y_{bp}, Z_{bp}) \tag{3}$$

According to a transformation table of the color system of CIE, the three theoretically primary colors $R_p(X_{rp}, Y_{rp}, Z_{rp})$ of the chromaticity coordinate $R_p(x_r, y_r)$ and the brightness $Y_{rp}$ of red color can be calculated as shown in the following equation (4):

$$R_p(X_{rp}, Y_{rp}, Z_{rp}) = \left(\frac{x_r \cdot Y_{rp}}{y_r}, Y_{rp}, \frac{(1 - x_r - y_r) \cdot Y_{rp}}{y_r}\right) \tag{4}$$

Meanwhile, the three theoretically primary colors $G_p(X_{gp}, Y_{gp}, Z_{gp})$ of the chromaticity coordinate $G_p(x_g, y_g)$ and the brightness $Y_{gp}$ of green color can be calculated as shown in the following equation (5), and the three theoretically primary colors $B_p(X_{bp}, Y_{bp}, Z_{bp})$ of the chromaticity coordinate $B_p(x_b, y_b)$ and the brightness $Y_{bp}$ of blue color can be calculated as shown in the following equation (6):

$$G_p(X_{gp}, Y_{gp}, Z_{gp}) = \left(\frac{x_g \cdot Y_{gp}}{y_g}, Y_{gp}, \frac{(1 - x_g - y_g) \cdot Y_{gp}}{y_g}\right) \tag{5}$$

$$B_p(X_{bp}, Y_{bp}, Z_{bp}) = \left(\frac{x_b \cdot Y_{bp}}{y_b}, Y_{bp}, \frac{(1 - x_b - y_b) \cdot Y_{bp}}{y_b}\right) \tag{6}$$

According to the equations (3), (4), (5), and (6), the three theoretically primary colors $(X_{wp}, Y_{wp}, Z_{wp})$ of the present white color of the display under a predetermined color temperature can be calculated as shown in the following equations (7), (8), and (9):

$$X_{wp} = \frac{x_r \cdot Y_{rp}}{y_r} + \frac{x_g \cdot Y_{gp}}{y_g} + \frac{x_b \cdot Y_{bp}}{y_b} \tag{7}$$

$$Y_{wp} = Y_{rp} + Y_{gp} + Y_{bp} \tag{8}$$

$$Z_{wp} = \frac{(1 - x_r - y_r) \cdot Y_{rp}}{y_r} + \frac{(1 - x_g - y_g) \cdot Y_{gp}}{y_g} + \frac{(1 - x_b - y_b) \cdot Y_{bp}}{y_b} \tag{9}$$

Then, by calculating a simultaneous equation of the equations (7), (8), and (9), the mixing ratio of the brightness $Y_{rp}$ of red color, the brightness $Y_{gp}$ of green color, and the brightness $Y_{bp}$ of blue color will be obtained, wherein the present white color of the display is constituted according to the mixing ratio.

In the same way, if it is supposed that an ideal white color under a predetermined color temperature has a chromaticity coordinate and a brightness $W_i(x_{wi}, y_{wi}, Y_{wi})$ the value $W_i(x_{wi}, y_{wi}, Y_{wi})$ can be calculated as shown in the following equations (10) by adding the three theoretically primary colors $R_p(X_{ri}, Y_{ri}, Z_{ri})$ of the chromaticity coordinate $R_p(x_r, y_r)$ and the brightness $Y_{ri}$ of red color, the three theoretically primary colors $G_p(X_{gi}, Y_{gi}, Z_{gi})$ of the chromaticity coordinate $G_p(x_g, y_g)$ and the brightness $Y_{gi}$ of green color, and the three theoretically primary colors $B_p(X_{bi}, Y_{bi}, Z_{bi})$ of the chromaticity coordinate $B_p(x_b, y_b)$ and the brightness $Y_{bi}$ of blue color:

$$W_i(X_{wi}, Y_{wi}, Z_{wi}) = R_p(X_{ri}, Y_{ri}, Z_{ri}) + G_p(X_{gi}, Y_{gi}, Z_{gi}) + B_p(X_{bi}, Y_{bi}, Z_{bi}) \quad (10)$$

Then, according to the transformation table of the color system of CIE, the three theoretically primary colors $R_p(X_{ri}, Y_{ri}, Z_{ri})$ of the chromaticity coordinate $R_p(x_r, y_r)$ and the brightness $Y_{ri}$ of red color can be calculated as shown in the following equation (11):

$$R_p(X_{ri}, Y_{ri}, Z_{ri}) = \left(\frac{x_r \cdot Y_{ri}}{y_r}, Y_{ri}, \frac{(1 - x_r - y_r) \cdot Y_{ri}}{y_r}\right) \quad (11)$$

Meanwhile, the three theoretically primary colors $G_p(X_{gi}, Y_{gi}, Z_{gi})$ of the chromaticity coordinate $G_p(x_g, y_g)$ and the brightness $Y_{gi}$ of green color can be calculated as shown in the following equation (12), and the three theoretically primary colors $B_p(X_{bi}, Y_{bi}, Z_{bi})$ of the chromaticity coordinate $B_p(x_b, y_b)$ and the brightness $Y_{bi}$ of blue color can be calculated as shown in the following equation (13):

$$G_p(X_{gi}, Y_{gi}, Z_{gi}) = \left(\frac{x_g \cdot Y_{gi}}{y_g}, Y_{gi}, \frac{(1 - x_g - y_g) \cdot Y_{gi}}{y_g}\right) \quad (12)$$

$$B_p(X_{bi}, Y_{bi}, Z_{bi}) = \left(\frac{x_b \cdot Y_{bi}}{y_b}, Y_{bi}, \frac{(1 - x_b - y_b) \cdot Y_{bi}}{y_b}\right) \quad (13)$$

According to the equations (10), (11), (12), and (13), the three theoretically primary colors $(X_{wi}, Y_{wi}, Z_{wi})$ of the ideal white color of the display under the predetermined color temperature can be calculated as shown in the following equations (14), (15), and (16):

$$X_{wi} = \frac{x_r \cdot Y_{ri}}{y_r} + \frac{x_g \cdot Y_{gi}}{y_g} + \frac{x_b \cdot Y_{bi}}{y_b} \quad (14)$$

$$Y_{wi} = Y_{ri} + Y_{gi} + Y_{bi} \quad (15)$$

$$Z_{wi} = \frac{(1 - x_r - y_r) \cdot Y_{ri}}{y_r} + \frac{(1 - x_g - y_g) \cdot Y_{gi}}{y_g} + \frac{(1 - x_b - y_b) \cdot Y_{bi}}{y_b} \quad (16)$$

Then, by calculating a simultaneous equation of the equations (14), (15), and (16), the mixing ratio of the brightness $Y_{ri}$ of red color, the brightness $Y_{gi}$ of green color, and the brightness $Y_{bi}$ of blue color will be obtained, wherein the ideal white color of the display are constituted according to the mixing ratio.

When compensating the three primary colors of the display by the gain values, the mixing ratio of the three primary colors could be adjusted to a lower level if the mixing ratio is excessive. On the contrary, the mixing ratio of the three primary colors could be adjusted to a higher level if the mixing ratio is insufficient. As a result, the three primary colors will be adjusted to compensate for excess or insufficient color performances until the display exhibits optimal color performances. In the preferred embodiment of the present invention, the three primary colors of the display are compensated based on the desired mixing ratio of the three primary colors of the ideal white color which is defined as a standard value. If the present mixing ratio of the three primary colors of the present white color of the display are higher than the standard value, the present mixing ratio thereof will be compensated by using gain values which are less than 1. On the contrary, if the present mixing ratio of the three primary colors of the present white color is lower than the standard value, the present mixing ratio thereof will be compensated by using gain values which are greater than 1. In other words, the gain values for compensating are in an inverse proportion to the present mixing ratio of the three primary colors of the present white color of the display. The gain values $(c_r, c_g, c_b)$ for compensating the three primary colors of red, green, blue of the display can be calculated as shown in the following equation (17):

$$(c_r, c_g, c_b) = \left(\frac{Y_{ri}}{Y_{rp}}, \frac{Y_{gi}}{Y_{gp}}, \frac{Y_{bi}}{Y_{bp}}\right) \quad (17)$$

Figure 3:
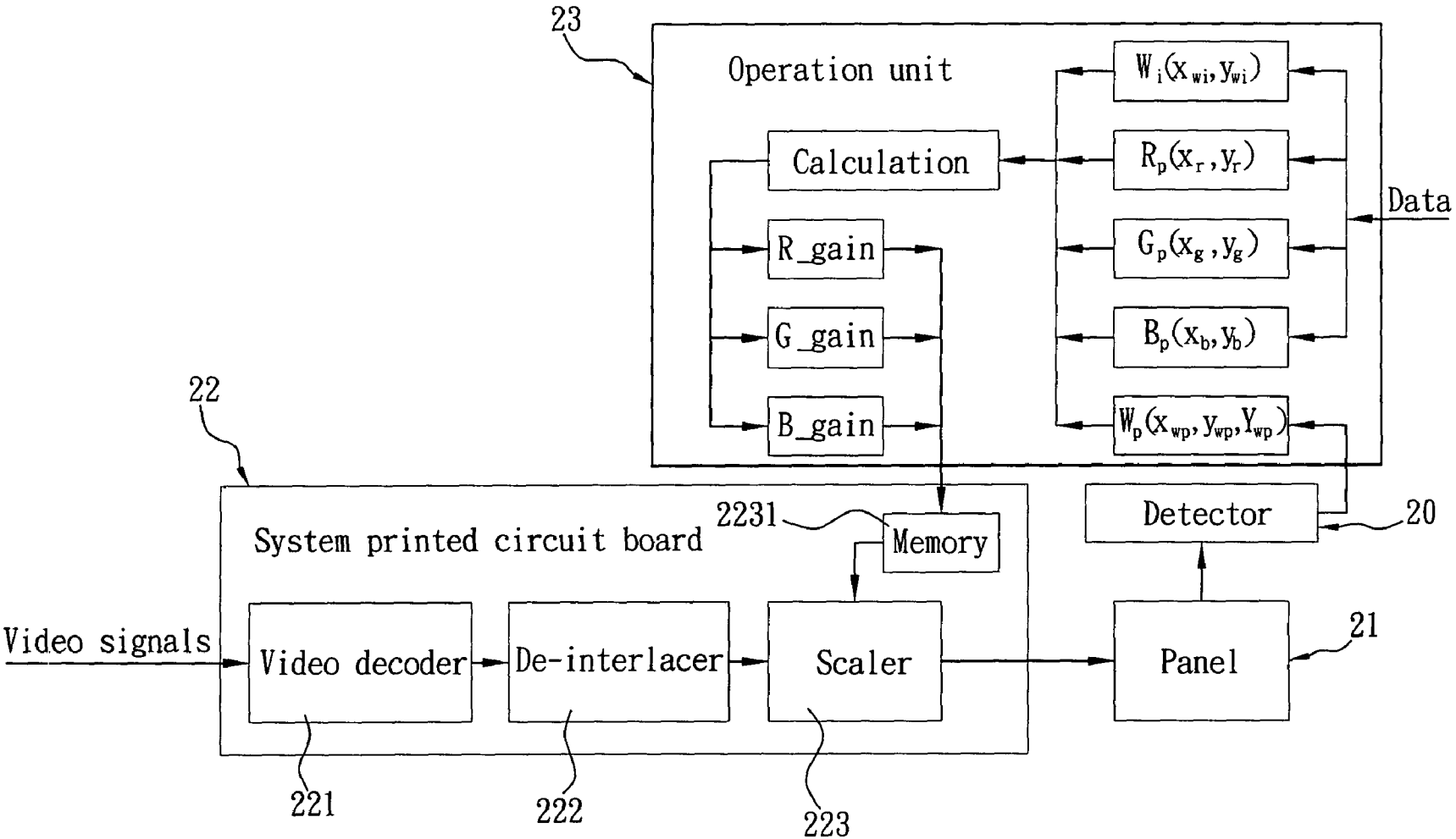
FIG. 3 is a block diagram of a circuit used in a method for automatically detecting and adjusting the grayscale/white balance of a display according to a second preferred embodiment of the present invention.
Figure 4:
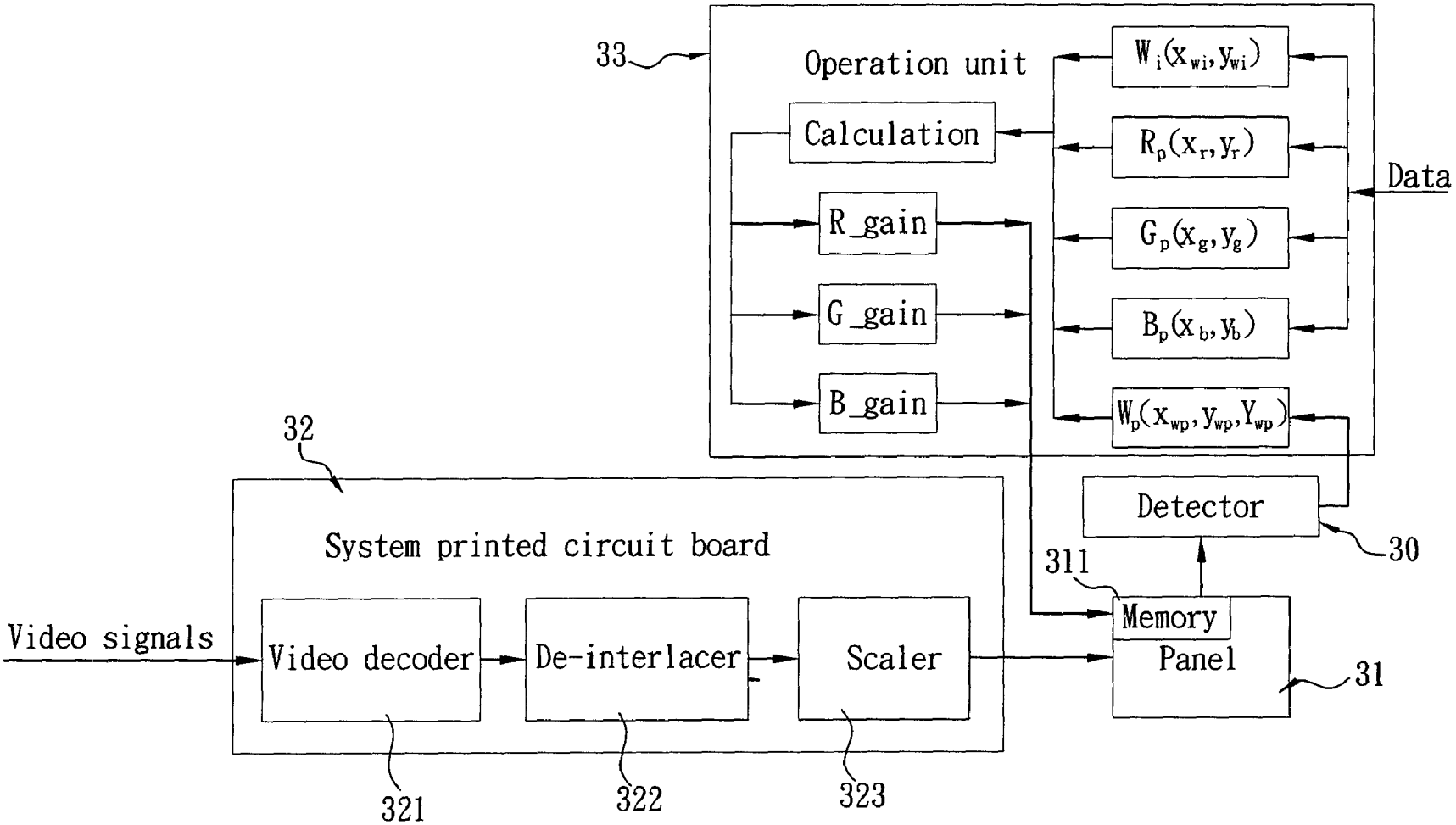
FIG. 4 is a block diagram of a circuit used in a method for automatically detecting and adjusting the grayscale/white balance of a display according to a third preferred embodiment of the present invention.

Referring to FIGS. 1, 3, and 4, various methods for automatically detecting and adjusting the grayscale/white balance of a display according to various preferred embodiments of the present invention are illustrated to describe more details hereinafter while referring to experimental data as shown in FIG. 2.

Referring now to FIG. 1, a method for automatically detecting and adjusting the grayscale/white balance of a display according to a first preferred embodiment of the present invention is illustrated, which is provided with a detector 10 for detecting a panel 11 of a display, wherein the detected data is that a color deviation of the panel 11 is about −0.002duv under a color temperature of 10600K, and a chromaticity coordinate $W_p(x_{wp}, y_{wp}, Y_{wp})$ of a present white color of the panel 11 is about (0.2792, 0.2821, 70.44). The detected data of the detector 10 is sent to an operation unit 13 for calculating. The operation unit 13 accesses a chromaticity coordinate $W_i(x_{wi}, y_{wi})$ of an ideal white color which is about (0.28528, 0.29299) under a predetermined color temperature of 9300K. Meanwhile, the operation unit 13 accesses chromaticity coordinate R(0.64, 0.33), G(0.29, 0.6), and B(0.15, 0.06) of the three primary colors of red, green, and blue of an EBU recommendation, which will be used to calculate the equations (7), (8), (9), and (14), (15), (16), respectively, to obtain the values $(Y_{rp}, Y_{gp}, Y_{bp})$ and $(Y_{ri}, Y_{gi}, Y_{bi})$ as shown in the following equations (18) and (19):

$$(Y_{rp}, Y_{gp}, Y_{bp}) = (0.0562717, 0.1956217, 0.0302066) \quad (18)$$

$$(Y_{ri}, Y_{gi}, Y_{bi}) = (0.0588305, 0.2053955, 0.0287640) \quad (19)$$

Then, the values $(Y_{rp}, Y_{gp}, Y_{bp})$ and $(Y_{ri}, Y_{gi}, Y_{bi})$ are used to calculate the equation (17) to obtain a set of gain values $(c_r, c_g, c_b)$ for compensating the three primary colors of red, green, and blue of the display, which is about (1.04547, 1.04996, 0.95224) Finally, the operation unit 13 sends the set of gain values to a memory 1231 of a scaler 123 formed on a system printed circuit board 12 of the display, in which the set of gain values is written. Thus, when video signals are inputted into the system printed circuit board 12, at least one video decoder 121 and a de-interlacer 122 provided by the system printed circuit board 12 are respectively used to decode and de-interlace the video signals in turn. Meanwhile, the scaler 123 is used to compensate the three primary colors of red, green, and blue of the video signals according to the set of gain values stored in the memory 1231, and then the compensated video signals are outputted to the panel 11 so that the panel 11 can exhibit the compensated video signals with optimal color performances.

Furthermore, due to the calculated gain values (1.04547, 1.04996, 0.95224) having fractional numbers, designs of digital circuits based on the gain values will be very complex, and may need more operating processes and operating times. In the first preferred embodiment of the present invention, the gain values ($c_r$, $c_g$, $c_b$) of red, green, and blue can be preferably normalized and converted into a ratio ($g_r$, $g_g$, $g_b$) which is equal to or less than 1. Moreover, the ratio ($g_r$, $g_g$, $g_b$) is further multiplied and converted into an integral number by a power of 2, such as $2^7=128$ for increasing adjustment accuracy, wherein the ratio is calculated as shown in the following equation (20) and (21):

$$(g_r,\ g_g,\ g_b) = \left(\frac{c_r}{\mathrm{Max}(c_r,\ c_g,\ c_b)}, \frac{c_g}{\mathrm{Max}(c_r,\ c_g,\ c_b)}, \frac{c_b}{\mathrm{Max}(c_r,\ c_g,\ c_b)}\right) \quad (20)$$

$$(G_r,\ G_g,\ G_b)=(128\times g_r,\ 128\times g_g,\ 128\times g_b) \quad (21)$$

According to the equation (21), the gain values ($G_r$, $G_g$, $G_b$) are converted into an integral ratio (127, 128, 116), and then written into the memory 1231 of the scaler 123 so as to automatically complete the adjustment of the three primary colors of red, green, and blue of the display.

After the adjustment, the detector 10 is used to detect the panel 11 again for ensuring values of the color temperature and the color deviation of the panel 11, wherein the color temperature is adjusted from an original value of about 10600K to a closely optimal value of about 9210K, and wherein the color deviation is adjusted from an original value of about −0.002 to a closely optimal value of about −0.0004. As shown in the experimental data of FIG. 2, the method of the present invention can be used to calculate relatively correct gain values of the three primary colors of red, green, and blue for adjusting the display until the display can exhibit video signals with closely optimal values of color temperature and color deviation. As shown in experimental data of FIG. 2 again, the method of the present invention can be repeated a plurality of times with optimal color performances.

As described above, the method of the present invention can be used to detect each of the displays in a batch for immediately calculating the desired gain values ($G_r$, $G_g$, $G_b$) of each of the displays before outputting the batch while the desired gain values ($G_r$, $G_g$, $G_b$) can be automatically written into the memory 1231 of the scaler 123 without any manual adjustment so as to automatically compensate the three primary colors of red, green, and blue outputted from the panel 11 until the panel 11 can exhibit optimal color performances in order to efficiently lower the manufacture time and the manual inaccuracy caused by the manual adjustment. Furthermore, the method of the present invention can be used to speed the adjustment of grayscale/white balance of each of the displays in a batch, wherein the grayscale/white balance of each of the displays is automatically adjusted until each of the displays can exhibit optimal color performance after detection and adjustment.

It should be noted that the first preferred embodiment of the present invention is described as above, and a second preferred embodiment of the present invention will be described in more detail hereinafter. Referring to FIG. 3, a display is provided with a panel 21 and a system printed circuit board 22. The system printed circuit board 22 is formed with at least one video decoder 221, a de-interlacer 222, a scaler 223, and a memory 2231, wherein the video decoder 221, the de-interlacer 222, and the scaler 223 are electrically connected to each other in turn, and the scaler 223 is further electrically connected to the memory 2231 and the panel 21. When a detector 20 is used to detect the panel 21, a chromaticity coordinate $W_p(x_{wp}, y_{wp}, Y_{wp})$ of a white color of the panel 21 under a predetermined color temperature is detected by the detector 20, and then sent to an operation unit 23. The operation unit 23 accesses a chromaticity coordinate $W_i(x_{wi}, y_{wi})$ of a predetermined white color under an ideal color temperature, while the operation unit 23 accesses chromaticity coordinate R (0.64, 0.33), G (0.29, 0.6), and B (0.15, 0.06) of the three primary colors of red, green, and blue of an EBU recommendation, which will be used to calculate the equations (20), to obtain a set of gain values ($G_r$, $G_g$, $G_b$) which will be written into the memory 2231. Thereby, when video signals are inputted into the system printed circuit board 22, the video decoder 221 and the de-interlacer 222 are respectively used to decode and de-interlace the video signals in turn. Meanwhile, the scaler 223 is used to compensate the three primary colors of red, green, and blue of the video signals according to the set of gain values stored in the memory 2231, and then the compensated video signals are outputted to the panel 21 so that the panel 21 can exhibit the compensated video signals with optimal color performances.

Referring to FIG. 4, a third preferred embodiment of the present invention will be described in more details hereinafter. As shown, a display is provided with a panel 31 and a system printed circuit board 32. The system printed circuit board 32 is formed with at least one video decoder 321, a de-interlacer 322, and a scaler 323, and the panel 31 is formed with at least one memory 311, wherein the video decoder 321, the de-interlacer 322, and the scaler 323 are electrically connected to each other in turn, and the scaler 323 are further electrically connected to the panel 31. When a detector 30 is used to detect the panel 31, a chromaticity coordinate $W_p(x_{wp}, y_{wp}, Y_{wp})$ of a white color of the panel 31 under a predetermined color temperature is detected by the detector 20, and then sent to an operation unit 33. The operation unit 33 accesses a chromaticity coordinate $W_i(x_{wi}, y_{wi})$ of a predetermined white color under an ideal color temperature, while the operation unit 33 accesses chromaticity coordinate R (0.64, 0.33), G (0.29, 0.6), and B (0.15, 0.06) of the three primary colors of red, green, and blue of an EBU recommendation, which will be used to calculate the equations (20), to obtain a set of gain values ($G_r$, $G_g$, $G_b$) which will be written into the memory 311. Thereby, when video signals are inputted into the system printed circuit board 32, the video decoder 321 and the de-interlacer 322 are respectively used to decode and de-interlace the video signals in turn. Meanwhile, after the video signals are outputted into the panel 31 via the scaler 323, the panel 31 is used to compensate the three primary colors of red, green, and blue of the video signals according to the set of gain values ($G_r$, $G_g$, $G_b$) stored in the memory 311 of the panel 31, and then the compensated video signals are shown on the panel 31 so that the panel 31 can exhibit the compensated video-signals with optimal color performances.

According to the method for automatically detecting and adjusting the grayscale/white balance of the display of the first, second, and third preferred embodiments of the present invention, the compensation of the three primary colors of red, green, and blue of the display is preferably carried out by circuit hardware. However, the compensation thereof is not limited to be carried out by circuit hardware, i.e. it also can be carried out in other equivalent manner, such as software, by anyone skilled in the art according to the concept of the present invention as described above and claimed hereinafter. Furthermore, in the present invention, the chromaticity coordinate of the present white color of the display can be detected by the detector 10, 20, or 30 to be used to calculate the gain values of the three primary colors of red, green, and blue for adjusting the grayscale/white balance of the display, and then the three primary colors of red, green, and blue of the display will be compensated via circuit hardware or equivalent software until the display can exhibit optimal color performances. Moreover, it should be also noted that the method of the present invention is not limited to select the chromaticity coordinate of the three primary colors of red, green, and blue for detection and adjustment, i.e. chromaticity coordinate of any three points in a chromaticity space can be also selected for detection and adjustment, although the method of the present invention preferably selects the chromaticity coordinate of the three primary colors of red, green, and blue in a color range of the display for calculating the gain values for adjustment.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A method for automatically detecting and adjusting grayscale/white balance of a display, which is applied to the display and comprising steps of:

detecting a chromaticity coordinate and a brightness of a present white color shown on the display under a predetermind color temperature by using a detector;

selecting a chromaticity coordinate of three primary colors of red, green, and blue in a known chromaticity space to calculate a present mixing ratio by using the three primary colors of red, green, and blue for producing the present white color according to Grassman's Law of color mixture in colormetry;

calculating a desired mixing ratio by using the three primary colors of red, green, and blue for producing an ideal white color under the predetermind color temperature according to Grassman's Law of color mixture in colormetry;

comparing the present mixing ratio of the present white color with the desired mixing ratio of the ideal white color to obtain a proportion therebetween which is then used to generate a set of gain values for adjusting the three primary colors of red, green, and blue inputted to the display; and writing the gain values into a memory of the display for automatically adjusting grayscale/white balance of the three primary colors of red, green and blue inputted to the display and then generating three new primary colors of red, green and blue outputted to a panel of the display.

2. The method for automatically detecting and adjusting grayscale/white balance of the display as claimed in claim 1, further comprising the step of:

adjusting the three primary colors of red, green and blue display based on the desired mixing ratio,which is defined as a standard value, wherein, when the present mixing ratio is higher than the standard value, the three primary colors of red, green and blue of the display are adjusted by using the grin values which are less than 1 and, when the present mixing ratio is lower than the standard value, the three primary colors of red, green and blue of the display are adjusted by using gain values which are greater than 1.

3. The method for automatically detecting and adjusting grayscale/white balance of the display as claimed in claim 2, further comprising the step of:

normalizing and converting the gain values into grain ratio each equal to or less than 1, wherein each of the grain ratio is further multiplied and converted into an integral number by a power of 2 for increasing adjustment accuracy.

4. The method of claim 1, wherein the set of gain values (Gain_R, Gain_G, Gain_B) is calculated by the following:

$$(\mathrm{Gain}_{13}R, \mathrm{Gain}_{13}G, \mathrm{Gain}_{13}B)=(128\times C_r/\mathrm{MAX}(C_r, C_g, C_b), 128\times C_g\mathrm{MAX}(C_r, C_g, C_b), 128\times C_b/\mathrm{MAX}(C_r, C_g, C_b)),$$

where $C_r$ is the proportion between the desired mixing ratio of red for the ideal white color and the present mixing ratio of red for the present white color, $C_g$ is the proportion between the desired mixing ratio of green for the ideal white color and the present mixing ratio of green for the present white color, and $C_b$ is the proportion between the desired mixing ratio of blue for the ideal white color and the present mixing ratio of blue for the present white color.

5. A system for automatically detecting and adjusting grayscale/white balance of a display, comprising:

a panel provided on the display;

a system printed circuit board formed with at least one video decoder, a de-interlacer, and a scaler, wherein the video decoder receives video signals for decoding the video signals, the de-interlacer is electrically connected to the video decoder for receiving decoded video signals transmitted from the video decoder and de-interlacing the decoded video signals, the scaler is electrically connected to the de-interlacer and the panel for receiving de-interlaced video signals transmitted from the de-interlacer, scaling the de-interlaced video signals, which are further transmitted to the panel, and wherein the scaler has a memory;

a detector for detecting a chromaticity coordinate and a brightness of a present white color of the display under a predetermined color temperature; and an operation unit electrically connected to the detector and the memory respectively, wherein, based on the chromaticity coordinate and the brightness of the present white color transmitted from the detector and a selected chromaticity coordinate of three primary colors of red, green, and blue in a known chromaticity space, the operation unit is used to calculate a present mixing ratio by using the three primary colors red, green, and blue for producing the present white color of the display according to Grassman's Law of color mixture in colormetry calculates a desired mixing ratio by using the three primary colors of red, green and blue for producing an ideal white color under the predetermined color temperature according to Grassman's Law of color mixture in colormetry, compares the present mixing ratio of the present white color with the desired mixing ratio of the ideal white color to obtain a proportion therebetween which is than used to generate a set of gain values of adjusting three primary colors of red, green, and blue inputted to the display, and then writes the gain values into the memory for autmoatically adjusting grayscale/white balance of the three primary colors of red, green and blue inputted to the display and then generating three new primary colors of red, green and blue outputted to the panel.

6. A system for automatically detecting and adjusting grayscale/white balance of a display, comprising:

a panel provided on the display;

a system printed circuit board formed with at least one video decoder, a de-interlacer, a scaler, and a memory, wherein the video decoder receives video signals for decoding the video signals, the de-interlacer is electrically connected to the video decoder for receiving the video signals transmitted from the video decoder and de-interlacing the decoded video signals, the scaler is electrically connected to the de-interlacer and the panel for receiving de-interlacer video signals transmitted from the de-interlacer scaling video signals, and transmitted scaled video signals to the panel, and memory is electrically connected to the scaler;

a detector for detecting a chromaticity coordinate and a brightness of a present white color of the display under a predetermined color temperature; and an operation unit electrically connected to the detector and the memory respectively, wherein, based on the chromaticity coordinate and the brightness of the present white color transmitted from the detector and a selected chromaticity coordinate of three primary colors of red, green, and blue in a known chromaticity space, the operation unit a present mixing ratio by using the three primary colors of red, green, and blue for producing the present white color of the display according to Grassman's Law of color mixture in colormetry calculates a desired mixing ratio by using the three primary colors of red, green and blue for producing an ideal white color under the predetermined color temperature according to Grassman's Law of color mixture in colormetry, compares the present mixing ratio of the present white color with the desired mixing ratio of the ideal white color to obtain a proportion therebtween which is then used to generate a set of gain values for adjusting three primary colors of red, green and blue of the display, and then writes the gain values into the memory for automatically adjuting grayscale/white balance of the three primary colors of red, and the gain values are written into the memory green and blue inputted to the display and then generating three new primary colors of red, green and blue outputted to the panel.

7. A system for automatically detecting and adjusting grayscale/white balance of a display, comprising:

a panel provided on the display and having at least one memory;

a system printed circuit board formed with at least one video decoder, a de-interlacer, and a scaler, wherein the video decoder receives video signals for decoding the video signals, the de-interlacer is electrically connected to the video decoder for receiving the video signals transmitted from the video decoder and de-interlacing the decoded video signals, the scaler is electrically connected to the de-interlacer and the panel for receiving the de-interlaced video signals transmitted from the de-interlacer and scaling the de-interlaced video signals, and transmitting scaled video signals to the panel;

a detector for detecting a chromaticity coordinate and a brightness of a present white color of the display under a predetermined color temperature; and an operation unit electrically connected to the detector and the memory respectively, wherein based on the chromaticity coordinate and the brightness of the present white color transmitted from the detector and a selected chromaticity coordinate of three primary colors of red, green, and blue in a known chromaticity space, the operation unit is used to calculate a present mixing ratio of the three primary colors of red, green, and blue of producing the present white color of the display accoeding to Grassman's Law of color mixture in colormetry, calculates a desired mixing ratio by using the three primary colors of red, green and blue for producing an ideal white color under the perdetermined color temperature according to Grassman's Law of color mixture in colormetry, compares the present mixing ratio of the present white color with the desired mixing ratio of the ideal white color to obtain a proportion therebetween which is then used to generate a set of gain values for adjusting three primary colors of red, green of the display, and then writes the gain values into the memory for automatically adjusting grayscale/white balance of the three primary colors of red, green, and blue inputted to the display and then generating three new primary colors of red, green and blue outputted to the panel.

* * * * *